US009561540B2

(12) United States Patent
Kusic

(10) Patent No.: US 9,561,540 B2
(45) Date of Patent: Feb. 7, 2017

(54) DIE CASTING NOZZLE AND METHOD FOR OPERATING A DIE CASTING NOZZLE

(71) Applicant: FERROFACTA GMBH, Allendorf (DE)

(72) Inventor: Igor Kusic, Allendorf (DE)

(73) Assignee: Ferrofacta GmbH, Allendorf (DE)

( * ) Notice: Subject to any disclaimer, the term of this patent is extended or adjusted under 35 U.S.C. 154(b) by 274 days.

(21) Appl. No.: 14/357,774

(22) PCT Filed: Nov. 15, 2012

(86) PCT No.: PCT/DE2012/100349

§ 371 (c)(1),
(2) Date: May 13, 2014

(87) PCT Pub. No.: WO2013/071926

PCT Pub. Date: May 23, 2013

(65) Prior Publication Data

US 2014/0319188 A1 Oct. 30, 2014

(30) Foreign Application Priority Data

Nov. 15, 2011 (DE) ..... 10 2011 055 398
Mar. 26, 2012 (DE) ..... 10 2012 102 549

(51) Int. Cl.
*B22D 41/08* (2006.01)
*B22D 17/20* (2006.01)
*B22D 17/22* (2006.01)

(52) U.S. Cl.
CPC ..... *B22D 17/2023* (2013.01); *B22D 17/2038* (2013.01); *B22D 17/2281* (2013.01)

(58) Field of Classification Search
CPC ..... B22D 17/2038
(Continued)

(56) References Cited

U.S. PATENT DOCUMENTS 4,635,851 A * 1/1987 Zecman ..... B22D 17/2038 222/593
4,638,849 A * 1/1987 Whitehorn ..... B22D 17/2038 164/155.6

(Continued)

FOREIGN PATENT DOCUMENTS

DE 10359692 A1 7/2004
DE 102005014566 A1 9/2006

(Continued)

*Primary Examiner* — Scott Kastler
(74) *Attorney, Agent, or Firm* — Michael Soderman

(57) ABSTRACT

Die cast nozzle for use in a die casting hot chamber system for molten metal with at least melting channel (4) in a channel carrier (3) that can be connected to a melt distributor (21), wherein the melting channel (4) passes over into a heating zone (6) and a nozzle tip (8), to which a sprue area (10) is attached, in which a plug of solidified melting can be formed that interrupts the melting flow, wherein the heating zone (6) comprises a heating cartridge (2) and/or a heatable nozzle shaft (33') and/or the nozzle tip (8) is comprised as heatable nozzle tip (8') and comprises at least one heating cartridge (2), the heatable nozzle shaft (33), or the heatable nozzle tip (8') as heating element with electric heating, which comprises high power density in at least one section and low thermal inertia, comprised in a way that a temperature change gradient of 20 to 250 K/s, preferably 150 K/s, can be achieved on the surface of the heating element. A method for operating the die cast nozzle is also the subject matter of the invention.

18 Claims, 4 Drawing Sheets

(58) Field of Classification Search
USPC ..... 222/590
See application file for complete search history.

(56) References Cited

U.S. PATENT DOCUMENTS

| | | | | |
|---|---|---|---|---|
| 5,315,686 | A * | 5/1994 | Caugherty | B22D 17/2038 222/146.5 |
| 5,448,678 | A * | 9/1995 | Booton | B22D 17/2038 222/146.5 |
| 2008/0017345 | A1* | 1/2008 | Weir | B22D 17/007 164/113 |

FOREIGN PATENT DOCUMENTS

| | | | |
|---|---|---|---|
| DE | 102006002341 | A1 | 7/2007 |
| EP | 0761345 | A2 | 3/1997 |
| EP | 1201335 | A1 | 5/2002 |

* cited by examiner

DIE CASTING NOZZLE AND METHOD FOR OPERATING A DIE CASTING NOZZLE

CROSS REFERENCE TO RELATED APPLICATIONS

This application is the U.S. national stage of International Application No. PCT/DE2012/100349 filed on Nov. 15, 2012, and claims the benefit thereof. The international application claims the benefit of German application DE 102012102549.5 filed on Mar. 26, 2012, and German application DE 102011055398.3 filed on Nov. 15, 2011; all applications are incorporated by reference herein in their entirety.

BACKGROUND

The present invention relates to a die cast nozzle and a method for operating a die cast nozzle for use in a die cast hot chamber system for molten metal with at least one melt channel in a channel carrier that can be connected to a melt distributor, wherein the melt channel passes over into a heating zone and subsequently into a nozzle tip, where a sprue section is connected. The die cast nozzle is intended for the formation of a plug in the sprue section made of solidified melting that interrupts the melt flow and can be re-fused entirely.

The sprue as a by-product of the casting that solidifies in the channels between the die cast nozzle and the casting mold in conventional die casting procedures and connects the cast parts after demolding in an ultimately undesirable manner, brings with it additional material input that is usually between 40 and 100 percent of the cast part's weight. Even if the sprue is melted down again for material recycling, this is connected with energy and quality losses due to emerging slag and oxide shares. The die cast without sprue avoids these drawbacks.

For die cast without sprue it is necessary to bring up the melting in liquid form from the crucible to the mold either for every cast and then bring it back, which results in loss of quality however, or at the least in loss of time, or as an alternative to this to hold the melting in liquid form up to the sprue of the mold. The latter is done in the hot chamber process, where all channels up to the sprue are heated in a way that the melting remains liquid and is at best prevented from reflowing to the crucible at the same time.

Reflow into the crucible can be prevented by valves, but also in a particularly advantageous manner by a plug of solidified melting that seals the sprue opening in the die cast nozzle.

Devices and methods for die cast or injection molding without sprue with the formation of a plug of solidified melting that seals a sprue section against melt flow and that can be re-fused again are known in the state of the art. Such devices and methods are particularly described for injection molding of plastics, but occasionally for die casting of non-ferrous metals.

The publication EP 1201335 A1 describes a hot chamber process for non-ferrous metals with a heated sprue die, the sprue section, where a reflowing of the melting into the channels and the crucible is prevented by a plug in the unheated nozzle die. The sprue die is heated externally. The plug comes loose from the wall of the sprue die when heated and is ejected from the nozzle die by the melting injected during the next molding procedure.

An intake room for the plug is required, so that the solid plug is not immediately injected into the mold. However, the flow of the melting during injection is obstructed by this. As this enters the mold with a velocity of 50 to 100 meters per second, the mold could be damaged by a loose plug that is carried by the melting. A controlled and complete re-fusing of the plug is not possible. Even if this was attempted, very long cycle times that would impair productivity would be required due to the sluggish external heating.

DE 33 35 280 A1 describes an electrically-operated heating element for heating molten metal in a hot chamber tool, whereby not only the die but the largest portion of the melting could be heated. Similar heating elements are extensively known in the state of the art for use within die cast nozzles for plastic melting. However, they perform a different task here. Because due to poor thermal conductivity and increased sensibility against local overheating, it comes down to ensuring an even temperature of the heating element when die casting plastics that is not too much in excess of the melting temperature. For use in metal die casting however, such heating elements can rarely be found even in literature.

The abovementioned publication DE 33 35 280 A1 has set itself to use such a one heating element in metal die casting. To do this, a heating element formed as a metal core is encompassed by an insulation layer that insulates the heating element against the metal outer sheath that is preferably made of construction steel.

The drawback here is that the heating rod has high thermal inertia due to the metal core, the insulation between heating and outer sheath as well as the metal outer sheath itself. It is possible to keep the melting in the die cast nozzle evenly warm however, but dynamic operation in time with the casting process is impossible. In particular it is not possible to seal the sprue section after every casting process using solidified melting and then re-fuse it afterwards, but the melting can only be permanently maintained in liquid form. Also, the metal outer sheath is exposed to the aggressive melting that would form an alloy with it in the interaction of high temperatures in the contact area between melting and outer sheath and that would corrode it in a short time.

The publication DE 10 2005 042 867 A1 also describes a die cast nozzle that is suitable for forming a plug that seals the sprue. However, the external heating on the nozzle leads to high thermal inertia, since the entire nozzle tip must be warmed for re-fusing and cooled down for the solidification of the plug. Due to inertia, long cycle times and as a consequence, low productivity or only partial melting of the plug ensues, that is then ejected into the mold. The abovementioned advantages of the specified documents of the state of the art bring along that the use of methods with solidifying plugs in the sprue section is not made. Low productivity and wear issues do not allow for use in practice so far.

This results in the task of providing a die cast nozzle with a heating cartridge and a method for its use, wherein the die cast nozzle should have thermal dynamics at high service life that enables operation in time with the casting process in a manner that the melting solidifies at least in a section of the die cast nozzle after every casting process insofar as a temporary seal of the nozzle ensues and emission or reflow of the melting is prevented.

SUMMARY

Die cast nozzle for use in a die casting hot chamber system for molten metal with at least melting channel (4) in a channel carrier (3) that can be connected to a melt distributor (21), wherein the melting channel (4) passes over into a heating zone (6) and a nozzle tip (8), to which a sprue area (10) is attached, in which a plug of solidified melting can be formed that interrupts the melting flow, wherein the heating zone (6) comprises a heating cartridge (2) and/or a heatable nozzle shaft (33') and/or the nozzle tip (8) is comprised as heatable nozzle tip (8') and comprises at least one heating cartridge (2), the heatable nozzle shaft (33'), or the heatable nozzle tip (8') as heating element with electric heating, which comprises high power density in at least one section and low thermal inertia, comprised in a way that a temperature change gradient of 20 to 250 K/s, preferably 150 K/s, can be achieved on the surface of the heating element. A method for operating the die cast nozzle is also the subject matter of the invention.

DETAILED DESCRIPTION

The purpose of the invention is solved by a die cast nozzle for use in a die casting hot chamber system for molten metal with at least one melting channel in a channel carrier that can be connected to a melt distributor, wherein the melt channel passes over into a heating zone and subsequently into a nozzle tip, where a sprue section is connected, in which a plug of solidified melting can be formed that interrupts the melting flow and where the heating zone has a preferably centred heating cartridge and/or a heatable nozzle shaft and/or where the nozzle tip is designed as heatable nozzle tip and at least the heating cartridge, the heatable nozzle shaft, or the heatable nozzle tip is designed as a heating element. The heating element is preferably designed with electric heating, has a high power density in at least one section and low thermal inertia and is furthermore designed in a way, so that a temperature changing gradient of 20 to 250 Kelvin per second (K/s), preferably 150 K/s, can be reached at the surface of the heating element. The sprue area within the sense of the invention comprises the entire section in which the plug forms according to the invention, so preferably in the section of the nozzle tip's recess that is preferably formed as truncated cone or as a cylinder.

With this, the temperature of the melting can drop quickly in the heating zone, but without solidifying the melting. Simultaneously, the temperature of the nozzle tip section or the heatable nozzle tip drops to the extent that solidification of the melting ensues in the sprue area and the injection point is sealed as a consequence. At the beginning of the casting process, the heatable area, for example the heating cartridge, alternatively or additionally the heatable nozzle tip, heats up just as quickly, the plug in the sprue section fused and the melting is enclosed in a die casting mold via the sprue area. The mostly instantaneous entry of thermal energy in the melting, particularly in the sprue area, is made possible by immediate thermal contact between the melting and an intrinsically highly dynamic heat source. For this, the heat source has materials with low inertia. With this, the heat required for fusion is applied to a very limited section in a targeted and energy-saving manner. The cooling also takes place in the very limited section, so that energy loss is low and the cooling rate high.

This prevents a reflow of the melting and elaborate refilling of the hot runners or the hot chamber. The quality of the cast parts is also increased, because no oxide or slag parts arise by contact with air that could reach the casting mold together with the melting.

It is advantageous, if the nozzle tip can be used separately and/or is made out of ceramic. The nozzle tip is very highly stressed, because the highest flow rates of the melting occur there due to the narrowing in the sprue area. Therefore it is advantageous, if the nozzle tip is exchangeable to replace it as wear part and to ensure proper continuous operation of the nozzle altogether. It is furthermore advantageous to make the nozzle tip out of very hard, wear-resistant, primarily chemically inert material such as ceramic (even if it is not exchangeable) to ensure high service life of the nozzle tip and so that the die casting nozzle is protected altogether or to extend the maintenance interval for replacement of the nozzle tip.

It is also favourable, if the die casting nozzle has a nozzle body that encases the channel carrier. With this, the channel carrier, possibly even the nozzle tip of the die casting nozzle is protected and above all, the thermal discharge from the hot channel carrier via the outer walls of the die casting nozzle is reduced with the goal of energy-saving operation.

A nozzle body or channel carrier made of titanium and/or with an insulator and/or at least a supporting ring and/or with at least one pressure piece as supporting element has special advantages. Titanium has low heat conductivity and is therefore particularly suited as sheath for the die cast nozzle. The insulating effect of a channel carrier sheath is furthermore improved, if between it and the nozzle body an additional insulator is installed, which then further reduces undesirable heat dissipation. In order to prevent additional heat dissipation from the nozzle body to the melt distributor, in which the die cast nozzle is installed in a preferred case of application, the die cast nozzle only comes in contact with the supporting rings of the nozzle body at the melt distributor, alternatively or additionally also by at least one insulating pressure piece. With this, strongly limited heat transfer can only ensue via relatively small contact surfaces between the hot die cast nozzle and the cool casting mold or the melt distributor.

It has also proven to be advantageous, if the melt channel has channel coating. Such coating, which is preferably made of enamel, prevents channel corrosion by the melting flowing through it. Other coatings are planned, for example on the basis of ceramic or applied by sputters.

It has furthermore shown that it is favourable, if at least of thermal sensor is provided in the heating zone and/or the sprue area for determining the melting temperature. This features low inertia in the preferred embodiment when recording the temperature measurement and can be brought into direct contact with the melting. The recorded temperature is submitted to a control system, alternatively to a control device. Using the control system, at least one of the heating elements is actuated in a way, so that the heating power is sufficient to achieve the desired melting temperature in the intended period of time.

In an alternative embodiment, thick-film heating (e.g. HTCC or LTCC), in which a metal conductor is embedded in the ceramic or coated with ceramic or glass, serves as thermal sensor. This is made by using the PTC effect, with which the specific resistance of the conductor changes with the temperature. With the selection of the metal for the conductor, wherein pure metal is especially possible, a particularly advantageous linear characteristic can be achieved. A thermal sensor integrated into the heating using the PTC effect without additional components other than the heating conductor with then double functionality as heating and sensor is expressly comprised according to this. At a PTC, a posistor, the resistance is higher, the hotter the metal is with the strongly oscillating atoms in the grid. With NTC, this effect also occurs, but there is an additional effect that counteracts it. This is a semiconductor then. If all atoms are fixed on the grid, a semiconductor is the perfect insulator. However, the links in the crystal break up due to energy feed during heating and the electrons become free, which then cause current flow. The faster the atoms move in the semiconductor crystal, the more frequently an electron is set free.

Next to a metal conductor, a thermal sensor can also have a ceramic conductor in the abovementioned embodiment and, particular corresponding manufacturing accuracy provided, use the PTC effect for temperature determination. The same basically applies to the NTC effect, if application is possible. Here, a non-linear characteristic must be considered when evaluating the measured data.

Particularly preferable is a melting temperature that is 20 K above the melting temperature of the material used the melting respectively. This way, it is ensured that the highly dynamic process in the die cast nozzle according to the invention can be accomplished with minimum use of energy. Furthermore, the thermal load to the die cast nozzle components is reduced, so that wear or chemical changes can be reduced or excluded. This way, the service life of the die cast nozzle is extended, no coatings are required in the areas where melt passes through and the die cast nozzle becomes more favourable altogether.

A die cast nozzle has particular advantages, if at least one cross-section change is planned that limits the heat flow to the sprue area. Such cross-section change can be achieved in the heating zone by designing the melting channel correspondingly; at the injection point by a tear-off edge or at the heating cartridge. There, cross-section change is preferably arranged between heating area and tip area that limits the heat flow to the sprue area.

By selecting the cross-section of the cross-section change, the thermal input can be set that can overflow from the heating area into the tip area. With this, it can be controlled, at which temperature in the heating zone of the melting channel the melting present in it solidifies considering the cooling time in the area of the nozzle tip. Furthermore, the temperature in the sprue section, the tip area or in the nozzle tip can be indirectly controlled by manipulating the temperature in the heating zone to be able to control the sealing of the sprue by a solidified melting plug according to the cycle.

The purpose of the invention is furthermore achieved by a heating element with electric heating and with a high power density (high-performance heating element) in at least one section and low thermal inertia, designed in a way, so that a temperature change gradient of 20 to 250 K/s, preferably 150 K/s, can be achieved on the surface of the heating element. The heating element for achieving low thermal inertia is made of materials with low density and high thermal conductivity, resulting in low thermal capacity. Since the materials themselves do not store a lot of heat, they can be heated up quickly and cool down just as quickly. The heating element is made of electrically well-insulating materials particularly on the surfaces, so that higher voltages can be used for operating the electric heating in order to be able to limit the current strength and thereby the cross-section of the feed lines as well as line loss.

A heating area, a tip area, a nozzle shaft and/or a nozzle is tip is preferred that is at least partially designed as high-performance heating element, that has a layer structure made of insulator ceramic and a heating conductor and that can be electrically contacted via contacts. The insulator ceramic forms at least on the outer wall and between heating conductors an electrically insulating barrier. Glass, enamel or frits (silicates) are particularly possible as insulator ceramic, too. The heating conductor can be contacted via electric connections (contacts).

The heating conductor is formed as conductor ceramic in the preferred embodiment. Ceramic is favourable, has a particularly low thermal capacity and resist material stress caused by temperature changes or conductor and insulator has similar expansion coefficients. Therefore, they are optimally suited for fast temperature changes. The insulator ceramic on the outer wall of the heating element is also resistant against the liquid melting and does not corrode under its influence.

As an alternative for the conductor ceramic or in addition to it, for example in combination of different systems, it is planned to introduce a metal conductor as heating conductor in the insulator ceramic. To do this, a preferably high-fusing metal powder, whose melting temperature is above the sintering temperature of the ceramic, is used. It is alternatively planned here, that the metal powder melts during sintering and elapsed in the insulator ceramic in a defined manner.

Another alternative for the design of the heating conductor is a metal conductor that is for example defined lithographically using a printing process and is introduced for example in thick-film technology, HTCC or LTCC into the insulator ceramic. The definition of the course and width of metal conducting tracks is preferably made by screen print or in a photochemical way. As metals for the conducting tracks as well as for contacting, particularly silver, a silver-palladium alloy, platinum, platinum alloys or gold paste come into consideration.

A particularly advantageous embodiment has a nozzle shaft that is connected to the nozzle tip in one piece. This evades the requirement of a connecting gasket between nozzle shaft and nozzle tip, to whose density very high demands are made due to high pressure and high flow rates of the melting in the area. Also, production is simplified.

A particularly advantageous embodiment of the one-piece nozzle shaft has heating systems that can be controlled separately at least in the area of the nozzle shaft and the nozzle tip. This way, the melting temperature in the different areas of the die cast nozzle can be controlled in a targeted manner, so that optimum process dynamics are achieved with minimum use of energy. The shaft, for example, can then be particularly well maintained in an even temperature closely above the melting point, wherein particularly preferred, one or several sensors monitor the temperature in this area and control the heating power accordingly. In contrast, fluctuating heating ensues in the area of the nozzle tip that can be achieved by the relatively small sprue area in the nozzle tip and the low thermal capacity in this area with high dynamics. With this, short cycle times and high productivity are possible with low use of energy. Alternatively, the use of a temperature sensor, for example as described in the above, is also planned.

Here it is favourable, if the heating elements outer or surface coating. In case that not the entire heating cartridge is made of ceramic, coating enables an increase of the resistance to the aggressive melting. Other materials for coating, such as enamel, glass, or frits are planned.

Alternative, an internal insert particularly in the sprue area is planned instead of coating, which preferably coats the highly stressed sprue area and mitigates the effects of wear due to flowing melting and still has good heat conductivity in the interest of long service life. Such insert is preferably made of low heat conducting ceramic, titanium or other materials with low heat conductivity, if it is a die cast nozzle exclusively heated by a heating cartridge. If the wall of the nozzle tip is also equipped with an individual heating, then the material of the internal insert must has good heat conductivity. In any case, favourable wear characteristics are required, meaning high wear resistance.

With suitable insulation, for example an outer insulating body out of titanium, excessive heat discharge from the nozzle into the mold is avoided and the heat is kept in the nozzle. This is not only desirable from an energetic point of view, but also in the interest of the casting mold service life. With this, the sprue area of the mold is characterised by only a minor wall thickness. This area would be strongly stressed by heat entry through the nozzle and the risk of material damage would ensue.

Also, the short cycle time and low thermal inertia of the die cast nozzle necessary for it, the high heating power and quick temperature reduction require that all outer factors such as uncontrolled heat discharge from the nozzle tip into the casting mold are limited in their effect. This is also achieved by thermal insulation between nozzle tip and sprue area of the mold and furthermore in an insulation as well as reduction of the contact surfaces between die cast nozzle and melt distributor.

Particularly advantageous, a thermal sensor arranged near the sprue is used, by which the temperature conditions in the area of the nozzle tip can be accurately recorded and used as a basis for regulation.

In an alternative embodiment, exact temperature control makes it possible to dispense with coatings in the areas of the die cast nozzle and that the can simply and favourably be made of steel. Using the exactly controlled temperature, excess temperature causing wear and undesired alloys between melting and nozzle material is avoided without risking an undesired increase of viscosity or freezing of the melting. Particularly, temperatures of >450° C. endangering the nozzle materials are avoided, because zinc already melts at a temperature of 390° C. and this margin is sufficient for a quick and exact control, as was surprisingly proven. In the preferred embodiment, the temperature is controlled so accurately that problem-free processing is possible with only a temperature of less than 20 K above the melting temperature.

Particularly advantageous processing, primarily in the abovementioned sense is possible with a heating cartridge that can be individually controlled in the heating area and in the tip area by separate electric connections or contacts, meaning it has separately controlled heating systems. With this it is possible that in both the heating zone and the tip area temperature guidance is achieved that is optimum and independent of each other respectively. With this for example, continuous heating in the heating zone or at the beginning of the casting process with low intensity can ensue with savings in energy, since the melting plug sealing the sprue area can be re-fused by targeted heating of only the tip area and the minor amount of melting present there.

An alternative that can be produced simply and is favourable has only one heating system that only requires a feed line and controls. In order to be able to control the temperature in the different areas of the die cast nozzle locally, the conductor density for example, its cross-section and/or in case of semiconductor material, the abatement is varied. With this, fine tuning is possible in a particularly simple manner, wherein the inclusion of measured values from thermal sensors has shown to be advantageous. Particularly good fine tuning is possible for heating systems that have been produced on the basis of thick-film technology. Especially for a well-engineered series product with high reproduction accuracy, the use of a single heating system is a useful alternative.

It is advantageous to have a heating cartridge that has an extended shaft or a shaft extended to a head that is guided through the melt distributor, so that the contacts are easily accessible outside the melt distributor. With this, it is simplified to produce and check the electric connections of the heating cartridge. Furthermore, minor requirements to heat resistance of the feed line insulation are imposed, because they do not have to be guided through the melt distributor that has a high temperature damaging the insulation material. So the functional and operational safety of the die cast nozzle is improved.

It is favourable if the heating cartridge is arranged in the centre or concentrically, so that preferably the heating zone and heating cartridge have the same central axis. Furthermore it is advantageous, if the heating cartridge between the shaft and the heating area has a centring guidance. With this, the heating cartridge has a particularly secure seat in the channel carrier and the centred arrangement in the melting channel, particularly in the area of the heating zone is ensured even with mechanical load by injected melting. This increased the die cast nozzle's quality is increased, because the melting reaches the sprue area and the casting mold with comprehensive even flow and without temperature differences between the individual flows within the melting channel or the melting channel.

It is also particularly advantageous, if a compensation device for balancing different thermal expansions of the channel carrier and the heating cartridge inserted into the channel carrier is planned, wherein the channel carrier has a seat for the heating cartridge. The heating cartridge is pressed against it and an expansion bolt with a pressure screw that is in contact with the channel carrier in a force transmission zone is planned. The expansion bolt is in contact with the heating cartridge in a contact zone, so that the heating cartridge is pressed against the seat during heating of the channel carrier, heating cartridge and expansion bolt. The force transmission zone is defined here in the preferred embodiment by the end of a thread in a slot nut, in which the pressure screw interferes, which is connected to the expansion bolt.

With this, the compensation of thermally conditioned expansions of components is made, which could cause loosening of the heating cartridge in its seat, because metal elements such as the nozzle body expand more that ceramic elements such as the heating cartridge. However, this problem is avoided by using a pre-stressed expansion bolt that expands in the same way as the channel carrier and not only counteracts loosening of the seat, but maintains or even increases the pre-tension depending on material pairing and dimensioning in the planned way.

Furthermore, the purpose of the invention is achieved by a method for operating a die cast nozzle with the steps operation of one or several of the heatable elements, particularly the heating cartridge, the heatable nozzle shaft, or the heatable nozzle tip, with increased power, where at least in one section the power density is so high and thermal inertia so low that a temperature gradient of 20 to 250 K/s, preferably 150 K/s, can be achieved on the heating element surface. At the same time or immediately afterwards, the melting is injected into the mold. A reduction of power or deactivation of the heatable elements and stopping of the melting flow follow. After all, the heatable elements are operated with such power that the melting in the heating zone remains liquid, but the heat is not sufficient to keep the melting on melting temperature in the area between nozzle tip and tip area, whereupon the melting solidifies there, seals the sprue area and prevents flowing in or reflowing of the melting. In detail, the following processes take place during the course of the method:

1. Closing of a Casting Mold.
   The closing of a casting mold takes place subsequent to the removal of the cast part produced previously that has been produced in the previous work cycle. The casting mold is closed so tight here that it withstands the high pressure of the melting.
2. Heating the die cast nozzle and complete re-fusing of the plug in the sprue area of the die cast nozzle by increasing the power of the heatable elements. An increase of power is made out of a closed current or, in the sense of activation, from a completely interrupted current flow. The thermal output introduced here is so high that the plug of solidified melting does not only melt in the periphery and is thereby loosened from the wall of the sprue area, but it melts completely. It then mixes in with the melting that is subsequently pressed into the mold and does not leave any traces behind, for example in the form of inhomogeneties in the casting part. Due to low thermal inertia, the re-fusing is made is such a short time that a high cycle frequency can be realised during casting.
3. Deactivation of Heatable Elements at Least Partially by Reducing the Power. Complete deactivation or significant reduction of thermal output is particularly important if it is a method where the nozzle is raised from the casting mold. Another heating is no longer required in any case, even without raising the nozzle, because the heat amount contained in the melting flow ensures the maintenance of the melting temperature by the melting that is flowing in with high temperature.
4. Injection of Melting into the Casting Mold.
   The melting flows through the nozzle, reaches the casting mold until it is completely filled with melting and the melting flow comes to a stand.
5. Maintaining the Pressure in the Melting.
   If no further melting flows in, the pressure applied to the melting during injection into the casting mold is maintained, until the melting has solidified. With this, safe filling of all cavities in the mold is ensured and air pockets and other casting errors are avoided.
6. Solidification of the Melting in the Casting Mold.
   In the filled casting mold, the melting solidifies to a cast part. Solidification can be accelerated by cooling channels through which coolant flows into the mold. The heat of the cast part is discharged with the coolant.
7. Solidification of the melting in the sprue area of the die cast nozzle. With the solidification of the melting in the cast part that is still in direct contact with the die cast nozzle, the heat of the melting in the sprue area of the die cast nozzle is discharged into the now cool cast part (primarily by cooling the casting mold). Thereby, the melting solidifies in this area, which also leads to sealing of this area. The sprue area of the die cast nozzle is now sealed by a plug that is formed very quickly due to low thermal inertia of the nozzle, so that short cycle times can be realised. The melting in the die cast nozzle behind the plug cannot flow in or out, nor can it pull in air into the die cast nozzle or flow back into the crucible via the channels. The die cast nozzle and the channels remain filled with liquid melting.
   In the alternative use of a nozzle with high thermal inertia, a special case of the method according to the invention, heat discharge from the nozzle tip into the casting mold is desired to support its cooling with the goal of freezing the melting.
   In another alternative embodiment, a non-return valve in at least one of the melt distributors closes and additionally prevents the melting from flowing back.
8. Opening the Casting Mold.

It is required for removing the cast part to open the casting mold. Since the die cast nozzle is sealed by a melting plug, the melting does not escape when the casting mold is opened, even after the sprue has broken away from the item.

9. Demolding of a Cast Part from a Casting Mold.
   After opening the casting mold, the cast part can be de-molded, meaning it can be removed from the casting mold. Here, a facilitated break of the item in the sprue area ensues due to a tear-off edge, which is a tapering and a pre-determined breaking point directly at the sprue.

If all or individually heatable elements, particularly the heating cartridge and/or the nozzle shaft are operated with increased power, the temperature of the melting is maintained, while it flows through the die cast nozzle. Premature cooling or an undesired increase of viscosity that could lead to a reduction in quality of the die casting component are avoided. If the power of the heatable elements is then reduced, this leads to a reduction of the temperature of the melting, but it still remains fluid in the heating zone.

If as a heatable element only one heating cartridge is applied, then a reduction of the power in the tip area causes a stronger cooling below the melting temperature of metal or other fluid material of which the melting is comprised. This leads to solidification and formation of a melting plug in the tip area of the heating cartridge, whereby the sprue area is sealed.

Therefore, no valve or another movable element is required for sealing the sprue area. This would be exposed to high wear due to melting, because the corrosive effect of the inevitably injecting melting between the movable parts would cause a premature failure of the valve or other movable elements.

However, the advantages of a sealed sprue can be used, which are primarily that a reflowing of the melting into the heating channels and the melting bath is prevented. Reflowing would imply that melting newly injected into the channel would carry slag or oxidised metal along and could press it into the casting mold and the result would be decreased component quality. Furthermore, the clock rate of the casting processes is increased, because emptying and refilling of the heating channels is omitted, because they are constantly filled with liquid melting.

It is particularly advantageous, if the portion of the heat flowing from the heating area in the sprue area between nozzle tip and tip area through the cross-section change was controlled from the outside in coordination with the amount of melting present in this section and the thermal output via the sprue area into the mold and the nozzle tip. With this, particularly coordinated to a melting with certain characteristics, the purpose of the invention can be achieved in a very simple and elegant way.

In addition to the cross-section change of the heating cartridge or alternatively, it is planned that the melting channel itself has a cross-section change. Another cross-section change is planned additionally or alternatively in the sprue area in the form of a tear-off edge. This tear-off edge is also a heat barrier, an area with increased thermal resistance between the die cast nozzle and melting and facilitates a separation of solidified melting in the die cast nozzle from the item even before the demolding, when the melting contracts during solidification.

In an alternative embodiment, the melting in the sprue area between nozzle tip and tip area is brought to the correct temperature via a separately heatable tip area. In comparison with another planned solution that only works with a cross-section reduction, a more flexible adjustment to changed melting properties or for changed requirements to functionality of the system is possible. The cross-section change that is present anyway, reduces the mutual influence of tip area and heating area. Improved options for control ensue with the use of other separately controllable heatable elements or areas as described in detail in the above.

A thermal sensor brings particular advantages, if it delivers a temperature value of a melting temperature to a temperature control device that regulates the melting temperature in the heating zone and/or the sprue zone, so that the melting temperature is only insofar above the melting temperature of the melting that a safe melting flow is ensured. This avoids inefficient waste of energy as well as wear due to high thermal load of the die cast nozzle components by safe processing.

Altogether, the present solution in all planned variants has the advantage that no plug is formed that could loosen after melting and that could reach the mold with the consequences stated at the beginning. Instead, the melting flow into the casting mold only after it has completely melted in the area of the sprue.

Insofar as the reference to metal melting is made in the above, an application of the device according to the invention and the method according to the invention is also planned for other materials, such as plastic melting with corresponding adjustments of the course of the method (temperature guidance, temperature gradient).

BRIEF DESCRIPTION OF THE DRAWINGS

Further details and advantages of the invention can be found in the figures and their description. They show.

DETAILED DESCRIPTION OF THE PREFERRED EMBODIMENT

Figure 1A:
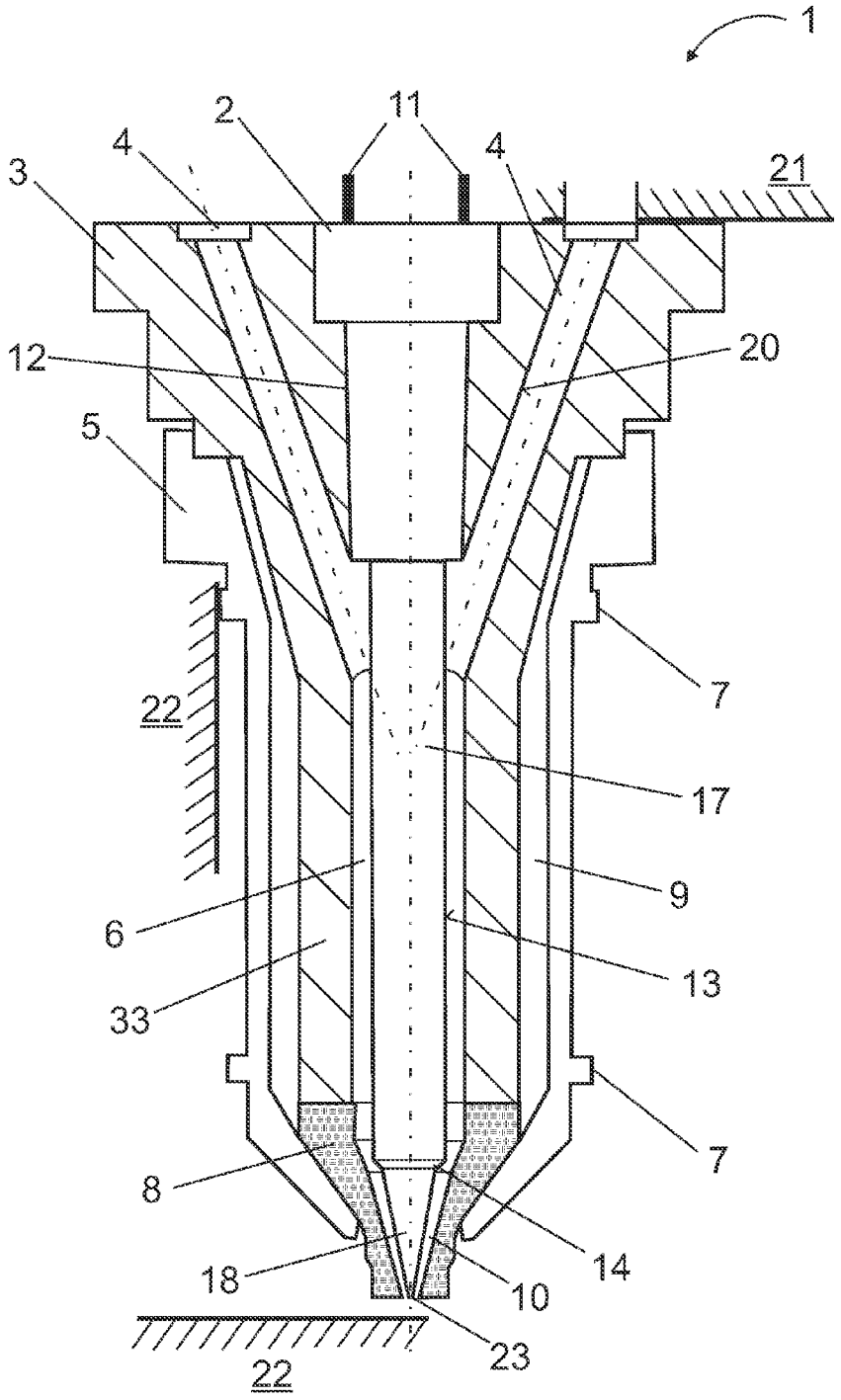
FIG. 1*a*: a schematic sectional view of an embodiment of a die cast nozzle with cartridge heating according to the invention.

FIG. 1*a* shows a schematic sectional display of an embodiment of a die cast nozzle according to the invention 1 with a heating cartridge 2, which is contacted by electric connections 11, a channel carrier 3, in which the melting channels that are designed as double in the presented embodiment are introduced, a nozzle body 5, which encases the channel carrier 3 and a nozzle tip 8 at the end of the die cast nozzle 1 facing the casting mold 22. The melting channels 4 run from an eccentric entry position of the melting from the melt distributor to a central bore in the nozzle shaft 33, the heating zone 6 and are protected in a preferred embodiment against the particularly corrosive effects of the melting by a channel coating 20. With this, a steel channel carrier 3 cannot form an alloy with the melting, nor be damaged in another way. As channel coating 20, enamel is used in the particularly preferred embodiment.

The melting channels 4 are formed in a way, so that they can be connected to the melt distributor 21 only implied in FIG. 1 and are supplied with melting by it. The melting channels 4 lead to heating zone 6, which is also a part of the melting channel 4 and in which the heating cartridge 2 with the heating area 17 extends into. With this, the melting can be heated if it is in heating zone 6 in nozzle shaft 33.

The heating cartridge 2 is also provided with a coating 13 in an alternative embodiment, which is similar to the channel coating 20 and protects the concerned surfaces against corrosion, adherence of slag or undesirable alloys. This particularly applies, if it is a heating cartridge 2 that is not made of ceramic.

The die cast nozzle 1 furthermore has a nozzle top 8 that is connected to the channel carrier 3 in the direction of a casting mold 22 that is only implied in FIG. 1. The nozzle tip 8 has in its centre an area tapering towards the injection point 23, in which the melting is oriented towards escaping from the die cast nozzle 1 at the sprue area 10. The nozzle tip 8 is planned as exchangeable in the preferred embodiment, so that this highly stressed component can be replaced easily upon wear, without the need to deactivate the entire die cast nozzle 1. It is particularly preferred to use highly wear-resistant material such as ceramic for the production of the nozzle tip 8. With this, the particularly high service life is ensured in spite of the high stress due to the melting that is discharged from the sprue with high velocity.

For reducing heat loss from the die cast nozzle 1, the area through which the melting flows, the channel carrier 3, is insulated. The insulation is preferably made by a nozzle body 5, whose heat transfer to the casting mold 22 is reduced, because the nozzle tip 1 only supports itself in the area of the supporting rings 7 on the casting mold 22. Another reduction of heat transfer is made by using an insulator 9 between channel carrier 3 and nozzle body 5. Air can also be used for this.

The permanently safe and fixed seat of the heating cartridge 2 in channel carrier 3 is ensured by a seat 12 of centring guidance.

The end of the heating cartridge 2 that points to the injection point 23 is formed by a preferably conical tip area 18. This forms in cooperating with the internal recess of the nozzle tip 8 a hollow-cone shaped space that is tapered off to the injection point 23 and through which the melting must flow with high velocity, before it escapes the die cast nozzle 1 via injection point 23. As soon as the melting cools down in this space of the sprue areas 10, it forms a tight plug that prevents escaping or reflowing of the melting and which does not loosen from the sprue area 10, even after it starts to melt when the heating begins and is loosened from the walls. The melting itself ensues fairly quickly and evenly, because the preferred hollow-cone shape of the plug has only a low wall thickness than a full profile and it can be heated up quickly.

The very quick solidification of the plug is facilitated by the fact that the melting flowing through the narrow space in sprue area 10 further heats itself during flowing due to friction and is still fluid when the cooling of tip area 18 begins. However, if the melting flow stops, not frictional heat occurs anymore and the melting solidifies immediately to the plug sealing sprue 10.

For re-fusing the plug, the heating area 17 of the heating cartridge is heated in the presented embodiment, so that the temperature of the melting in the heating zone 6 also rises. With this, the heat is guided on the one hand via the melting to the plug and on the other hand through the zone of cross-section change 14 to the tip area 18. With the formation of the cross-section change 14 it can be controlled, to what extent the heat is transferred to the tip area 18. This way, the time of re-fusing can be controlled subject to the temperature that the heating area 17 reaches.

Figure 1B:
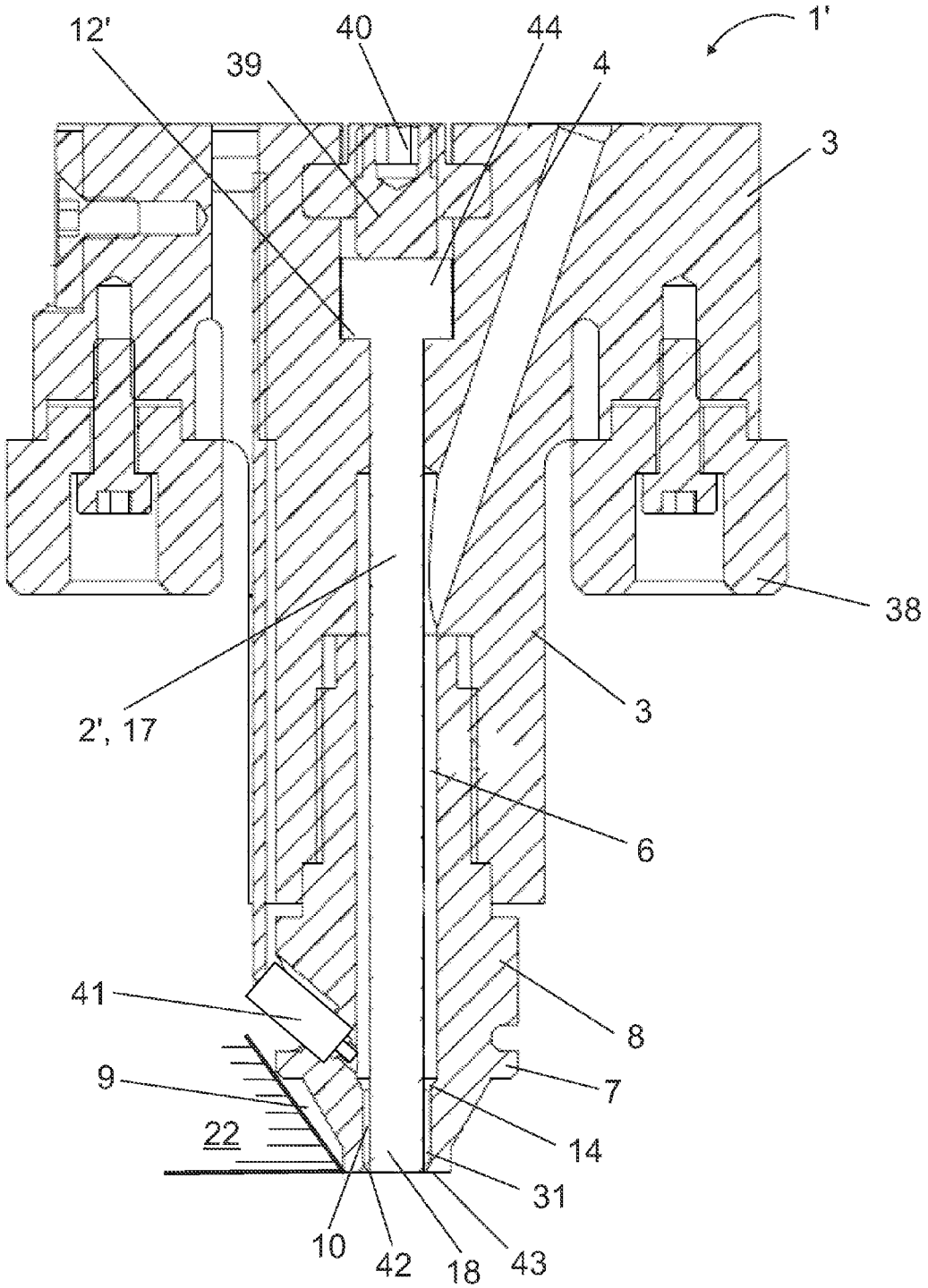
FIG. 1*b*: a schematic sectional view of an embodiment of another die cast nozzle with cartridge heating according to the invention.

FIG. 1*b* shows a schematic sectional display of another embodiment of a die cast nozzle 1' according to the invention with cartridge heating using heating cartridge 2'. The heating cartridge 2' has a head 44 here that is formed cylindrically and is pressed against a seat 12' in the bore of channel carrier 3 by an expansion bolt 39 in connection with a pressure screw 40. Here, the pressure screw 40 generates a pre-tension of the expansion bolt 39, connected with a force effect to the head 44 of the heating cartridge 2'.

If the die cast nozzle 1' commences operation, all components are heated to operating temperature, which approaches 450° C. in the preferred method. As a consequence, expansion of components subject to heat ensues, where metal elements such as channel carrier 3 expand more than ceramic elements such as the heating cartridge 2. As a result, the heating cartridge 2 would loosen in its seat 12'.

This is however prevented by the use of a pre-tensioned expansion bolt 39, which also expands significantly such as channel carrier 3 in an expansion area and which counteracts a loosening of seat 12'. The expansion area stretches from 12' up to the end of the thread in a slot nut positively connected to channel carrier 3, in which the pressure screw 40 intervenes. Instead, the recorded pre-tension of seat 12' is maintained by the pressure screw 40 and the heating cartridge 2 remains fixed on its head 44 fest in its seat 12'. Due to appropriate design in the thermal expansion of cooperative elements, here channel carrier 3 and expansion bolt 39, an increase of tension can be generated here. This would result in a better force fit during operation without bringing the attached element, the head 44 of the heating cartridge 2, to flowing by strong permanent pressure load, if the material used for this should lean towards such an effect.

For the reduction of heat flow from the die cast nozzle 1', a supporting ring 7 as well as a pressure piece 38 are planned. With these elements, the die cast nozzle 1' supports itself on the casting mold 22 during the casting process, if it drops down to the casting mold 22 during the casting process. Due to selective dropping down and the use of material with low heat conductivity, the heat flow from the die cast nozzle 1' into casting mold 22 is reduced. In the area of nozzle tip 8, an insulator 9, preferably an air space, is planned. Alternatively or additionally, an insulating element, for example a disc made of titanium is planned for arrangement in the area of the front surface 43 of nozzle tip 8, in order to prevent the discharge of heat directly into the sprue area of the casting mold.

A cross-section change 14, here in the cross-section in the melting channel 4, takes care of the defined heat transfer via the melting in the sprue area 10 of nozzle tip 8. Alternatively or additionally, a cross-section change of the heating cartridge 2, according to FIG. 1*a*, is planned. Additionally, another cross-section in the form of a tear-off edge 42 is planned in the presented embodiment. This does not only prevent heat discharge into the casting mold via the melting, but also provides a pre-determined breaking point for the solidified melting, on which the solidified melting shrinking during cooling tears off from the item even before the molding process. If the nozzle tip 8 is comprised of titanium as in the preferred embodiment, an internal insert, preferably comprised of resistant ceramic or tungsten, is an advantage in the sprue area 10, because the melting that flows there with high velocity would otherwise cause extensive wear.

The use of a thermal sensor 41 has proved to be particularly advantageous. This is arranged near the sprue area 10 in the nozzle tip 8 preferably comprised of insulating titanium in the preferred embodiment. The measured temperature value that the thermal sensor 41 delivers is preferably processed in a control system. This will then provide exact temperature guidance subject to time in every section of the die casting process with the result of an effective use of energy as well as minimum thermal load on the elements guiding the melting. With this, special measures for preventing thermal wear or undesirable alloys such as coating can be omitted.

The melting channel 4 runs from the connection area with the melt distributor through the channel carrier 3 deviating from the vertical, until it comes up to the heating zone 6, which receives the heating cartridge 2, and runs further in the heating zone 6 to the nozzle tip 8. Heating area 17 and tip area 18 merge into each other in this embodiment of the heating cartridge 2" with cross-section change. The internal insert 31 mitigates wear and increases the service life of nozzle tip 8.

Figure 2:
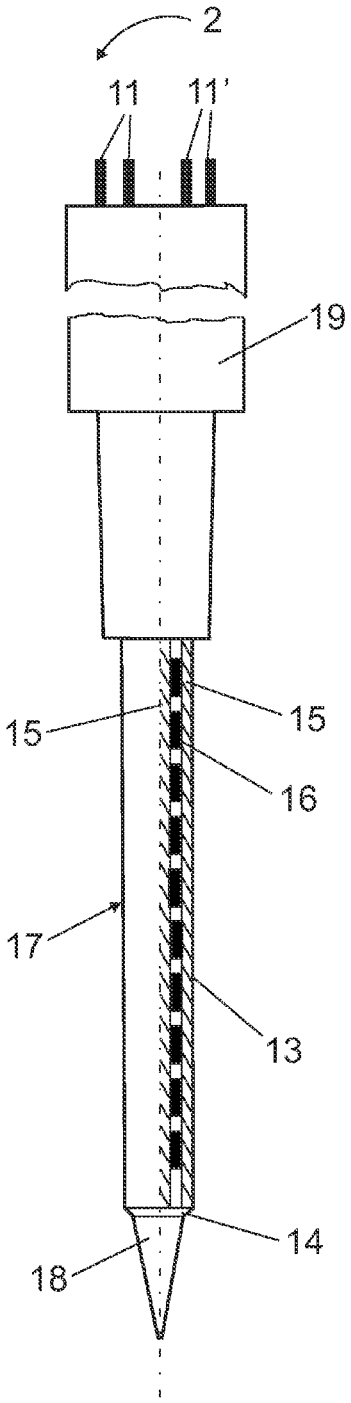
FIG. 2: a schematic sectional view of an embodiment of a heating cartridge according to the invention in sectional cut.

FIG. 2 shows a schematic display of an embodiment of a heating cartridge 2 according to the invention in sectional cut, which shows the heating area 17. There, a multi-layer structure of the heating system can be seen, which in the particularly preferred embodiment has as a central core as well as circumference and for insulation of the conducting areas from each other an insulator ceramic 15 respectively. Embedded between these in the presented embodiment of concentric layers is the conductor ceramic 16, which serves as heating system using its electrically conducting properties. The individual conductor loops are also preferably electrically insulated against each other by insulator ceramic 15.

Heating cartridges 2 comprised of high-performance ceramics are particularly well suited for die cast nozzles with short cycle times, which must be heated with quickly changeable heating requirement.

Even though full ceramic heating elements heating elements with insulating and conducting ceramic are basically known, wherein the heating function in the previous application according to the state of the art is only integrated into high-strength ceramics such as cutting knives, welding jaws and tools. The ceramic heating element according to the invention is integrated in a totally different way than the state of the art, in particular into a die cast nozzle as heating system, wherein it is controlled highly dynamically by using its thermal properties.

As materials in the preferred embodiment of the heating cartridge 2 according to the state of the art, known ceramics are used that have various advantages compared to metal heating elements. Particularly favourable is the high surface power of up to 150 W/cm$^2$ and the radiation emission of e>0.9, wherein temperatures of up to 1000° C. can be reached, which is of particular interest for refractory non-ferrous metals such as aluminium, which can be processed in the die casting process.

Other advantages include short heating-up times, minor residual, which facilitates quick cooling down, and a very high controllability due to minor thermal mass. Particularly due to the minor thermal capacity of the ceramic because of its low density, high heating rates can be realised with low energy intake. High heat conductivity and minor mass of the ceramic heating body ultimately cause low thermal inertia.

The full ceramic heating elements are resistant against oxidation and acids. They have low wettability with liquid metals, high mechanical strength, high heat conductivity as well as high electric insulation resistance and high disruptive strength at the same time. They also have high hardness and fine wear-resistance.

Attributable to fine and safe electric insulation to the outside, the heating cartridge 2 can be operated with higher voltages, preferably 230 V. This has the advantage that less current strength must be conducted to the heating system and the cross-section of the feed lines can be correspondingly small. Saving of costs and minor power loss are the result. With the preferred power of 400 W, only a current strength of 1.8 A is required.

The electrically conducting ceramic and the shell of insulating ceramic are sintered to a homogeneous body and therefore facilitate very high power densities with high mechanical stability at the same time. The fine resistance to age and wear ensures long service life even with high temperatures.

Alternative embodiments plan however, to use other materials for the heating cartridge 2, such as steel. Particularly in this case, a coating 13, preferably enamel, is required to produce corresponding surface properties, primarily to reduce wear. Next to high wear-resistance, the prevention of oxidation under the influence of aggressive melting and a minor tendency of adherence for metals on the surface shall be achieved.

The heating cartridge is alternatively manufactured from a ceramic with at least one metal conductor integrated into it, wherein the metal conductor is prepared as metal powder, preferably refractory, as massive conductor or prepared in a lithographic procedure and introduces as a film. For this, preferably procedures such as thick-film technology, HTCC or LTCC are planned.

A particularly preferred embodiment of the heating cartridge 2 provides for separated heating in heating area 17 and the tip area 18, which can also be controlled individually via the electric connections 11, 11'. With this, the heating area 17 can be continuously supplied with as much energy to keep the melting liquid in a particularly energy-saving manner. The tip area 18 however, can be heated and cooled down in a clocked, targeted manner, so that solidification and refusing of the little amount of melting that is present in the periphery of the tip area 18 is made possible. Via the cross-section change 14, the mutual influence of the heating area 17 and the tip areas 18 is minimised and the independent function of both areas is supported.

Furthermore planned is the heating of only the tip area 18 or other delimited areas of the die cast nozzle.

The shaft 19, which is shown as interrupted, preferably has such a length that is stands out from upwards from the melt distributor, that the contacts 11, 11' are easily accessible and a cable duct through the melt distributor is avoided by this.

Figure 3:
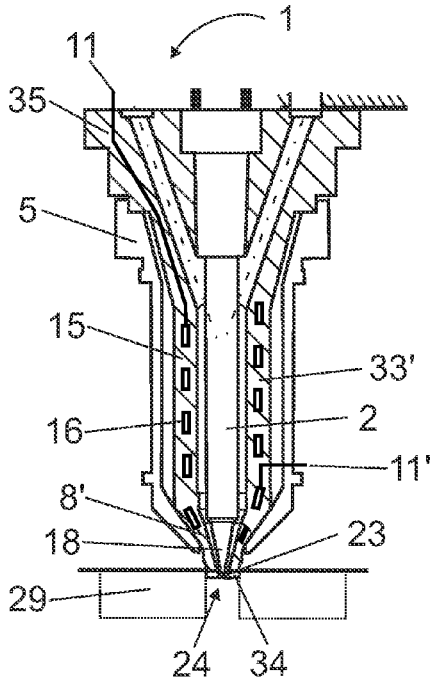
FIG. 3: a schematic sectional display of an embodiment of a die cast nozzle according to the invention with cartridge and shaft tip heating as well as lateral gating.

FIG. 3 shows a schematic sectional display of an embodiment of a die cast nozzle 1 according to the invention with cartridge and shaft tip heating and lateral gating 34, here with injection mold 24 in the shape of a star for producing the items 29. A nozzle shaft 33 is used for this, which can be heated directly and that has a structure of an insulator ceramic 15 and conductor ceramic 16 for this, similar to the heating cartridge 2 described above. A special feature is that the nozzle shaft 33' and the nozzle tip 8' are designed in one piece and can be heated. Preferably, the largest portion of heating power is generated in the area of the nozzle tip 8', particularly preferably in the first 1 to 15 millimeters when viewed from the injection point 23. Enough heating power is entered here that the heat drop in the front area of the nozzle is compensated. This depends of external factors such as thermal insulation and heat-conducting contact surfaces.

Thereby even heating of the melting is achieved by both the heating cartridge 2 as well as the nozzle shaft 33'. The electric connections 11, 11' is made from the outside here, for example via head plate 35, where the die cast nozzle 1 is in contact with the melt distributor.

Alternatively to this, a melting temperature in the area of heating cartridge 2 that is overall too high can be countered by operating it with low temperature or entirely unheated. So you do not need to make sure that sufficient heat flows into the tip area 18. Rather the temperature conditions in the area of only the nozzle tip 8 can be controlled in a targeted manner.

Figure 6:
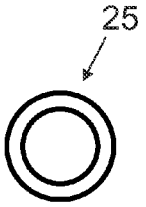

Instead of the presented peaked shape of the heating cartridge 2, it is alternatively planned here that it maintains its cylindrical shape and the full diameter up to injection point 23 and that it increases the ring diameter of the sprue 25 from FIG. 6 in such a manner that the production of several parts is facilitated by lateral injection or parts with larger dimensions can be produced. An extension of the heating cartridge 2 diameter in the tip area 18 is planned and preferred in particular.

Furthermore, a solution is given preference, in which the entire die cast nozzle 1 in the outer area of a nozzle body 5 comprises a sheath of titanium or has at least an insulating air layer towards nozzle shaft 33'.

Figure 4:
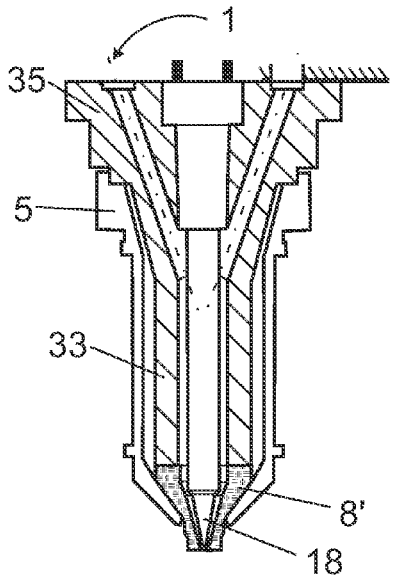
FIG. 4: a schematic sectional display of an embodiment of a die cast nozzle according to the invention with cartridge and shaft tip heating.

FIG. 4 shows a schematic sectional display of an embodiment of a die cast nozzle 1 according to the invention with cartridge and tip heating. Here, a nozzle shaft 33 is used that cannot be heated. A separate nozzle tip 8' is planned for heating the melting, which also has conductive and insulating ceramics corresponding to the description mentioned above and which can therefore be heated. The electric connection that is required for this is preferably introduced via the nozzle shaft 33 to the head place 35 or conducted through the nozzle body 5 directly to the outside. With this, a favourable structure is achieved, because only in the area of the nozzle tip 8' a heating ceramic is required, where particularly high temperatures and most of all high dynamics between melting and solidifying temperature are required. Next to this, the tip area 18 is also designed as heatable.

Figure 5A:
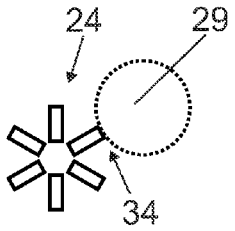
FIGS. 5*a* and 6 to 9: a schematic top view of a sprue schematic of a die cast nozzle according to the invention respectively.

FIG. 5*a* shows a schematic top view of a sprue pattern of a die cast nozzle according to the invention in the mold of a star 24 and lateral sprue 34. An item 29 is furthermore indicated, a product of the planned die casting process. This is produced using the star mold 24 of the sprue in lateral gating 34. With this, several parts can be produced with one die cast nozzle without a channel system that would result in a solidified so-called tree upon molding, which would have to be separated from the item. In the present case with the example of the presented sprue structure in the mold of a star 24 these are six items 29 that can be produced in one process.

Figure 5B:
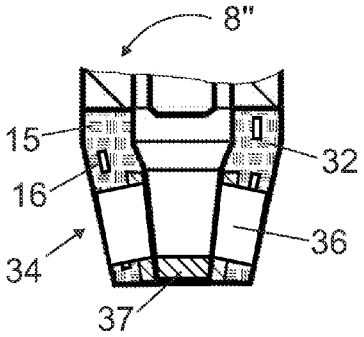
FIG. 5*b*: a schematic sectional display of a detail of an embodiment of a die cast nozzle according to the invention for lateral gating.

FIG. 5*b* with the nozzle tip 8" shows a schematic sectional display of a detail of an embodiment of a die cast nozzle according to the invention with lateral gating 34, wherein the injection point is sealed by a nozzle plug 37. Here, a nozzle tip, a nozzle ring or a nozzle bar is planned depending of the specific shaping of the structure of the nozzle tip 8", both heated and unheated versions. Furthermore, a separate nozzle seal 37 is also comprised just as a nozzle tip in one piece without opening in the injection point. Openings in the wall of nozzle tip 8" are planned as lateral sprue 36 for discharging the melting into the laterally arranged sprue area of the casting mold that is not displayed.

Here, a rotationally symmetric arrangement around a conical wall of nozzle tip 8" is according to the invention just as an elongated nozzle tip 8", in which the lateral sprues are arranged linear in series. The preferred structure of the heating ceramic nozzle comprised of insulation ceramic 15 and conductor ceramic 16 is displayed.

FIG. 6 shows a schematic top view of a sprue pattern of a die cast nozzle according to the invention in the mold of a ring 25. Such a mold is created, just as shown in FIG. 1, when the tip area 18 reaches up to the injection point 23. If a larger ring diameter is required, this can be achieved by a larger diameter of the tip areas 18 at the injection point 23.

Figure 7:
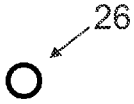

FIG. 7 shows a schematic top view of a sprue pattern of a die cast nozzle according to the invention in the mold of a point 26. In contrast to the ring mold 25 shown in FIG. 6, this mold 26 is achieved, if there is no tip area 18 according to FIG. 1 and instead, just as shown in FIG. 10, the stumpy heating cartridge 2' does not reach into the nozzle tip 8.

Figure 8:
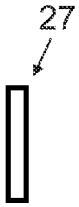
Figure 9:
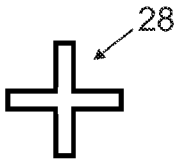

FIG. 8 and FIG. 9 show a schematic top view of a sprue pattern of a die cast nozzle according to the invention in flat mold 27 or in the mold of a cross 28. The basic structure of the die cast nozzle corresponds to the one described in FIG. 7, meaning without the tip area 18 reaching too far into the nozzle tip 8. The mold of the sprue 23 as a flat mold 27 is the result of the corresponding molding of nozzle tip 8. Particularly advantageous is a flat mold 27 for items with large longitudinal extension. An even flow of melting material into four directions however is achieved by applying the mold of a cross 28.

It is furthermore planned that the abovementioned injection molds can be evoked by a respectively exchangeable tungsten disc with the corresponding injection mold, which is set to the nozzle at injection point 23. With this, different injection molds can be applied without having to change the die cast nozzle 1 altogether.

Figure 10:
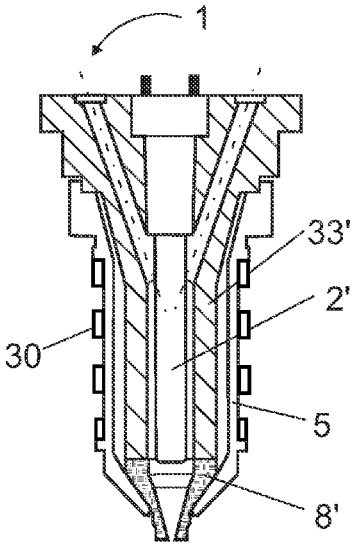
FIG. 10: a schematic sectional display of an embodiment of a die cast nozzle according to the invention as coil tube cartridge.

FIG. 10 shows a schematic sectional display of an embodiment of a die cast nozzle 1 according to the invention with twisted pipe 30. With this, the entire nozzle body 5 can be heated in the external area. The twisted pipe 30 is placed around the outer sheath. By heating it, the entire die cast nozzle 1 receives a more even temperature distribution and the energy input into the heating cartridge 2', the nozzle shaft 33' or the nozzle tip 8' can be made with less energy input. The energy applied to the elements mentioned last can therefore have higher dynamics in the interest of faster casting processes and shorter cycle times according to the description of plug formation in the sprue area mentioned in the beginning. Also, the thermal load of sensitive melting, primarily plastics, is lower.

Figure 11:
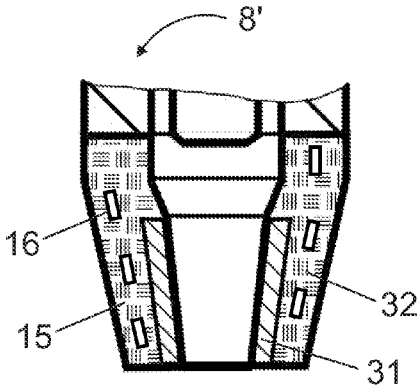
FIG. 11: a schematic sectional display of a detail of an embodiment of a die cast nozzle according to the invention with tip heating and internal insert.

FIG. 11 shows a schematic sectional display of a detail of an embodiment of a die cast nozzle according to the invention with tip heating and internal insert 31, comprised as heating ceramic nozzle 32. Here in the presented embodiment, a nozzle tip 8' with a ceramic structure is applied to a nozzle shaft as described in FIGS. 2, 3, and 4. Due to the structure of the insulator ceramic 15 and the conductor ceramic 16, a high conductor density is generated in this area, through with much heating power can be introduced to this area. The nozzle tip 8' represents only a very small quantity of material compared to the other components of the die cast nozzle, so that heating and cooling down are possible with very high dynamics and quick changes of the cycle. The power density can be set for every section by the cross-section of the conducting areas of conductor ceramic 16, and by corresponding abatement. These parts are overwrought after burning for giving them their exact shape and a layer of insulator ceramic 15 always remains on the outside.

In order to prevent wear on the highly stressed internal sheath, the surface that comes in contact with the melting, a coating, but particularly preferably an internal insert 31 is used here. This is comprised of tungsten, but also other materials with high resistance to wear, high melting point and high heat conductivity such as ceramic conducting heat are used.

In alternative embodiment, where the nozzle tip 8' is comprised of steel, but particularly if it is comprised of titanium, an internal insert 31 that reduces wear is of particular importance. In comparison it is planned for a nozzle tip 8' comprised of ceramic, in turn a very sturdy, wear-resistant material not prone to chemical bonds or alloys, to dispense with the use of an internal insert 31. An outer insulation not presented here is however planned for the preferred embodiments of both versions in order to avoid heat discharge from the die cast nozzle.

The reduction in wear ensues alternatively or additionally to the abovementioned measures using a special method. It has proven to be favourable, if the power of the heatable elements in the sprue area is controlled in a manner that the wear of the sprue areas is minimised. The control system only provides as much power as is needed for re-fusing the melting plug in the sprue area. With this, the wear in the die cast nozzle in the sprue area is further reduced. The control of the thermal power ensues according to the material of the melting as well as other parameters of the die cast nozzle such as injection geometry.

Alternatively to a control by fixed parameters it is planned that a regulation processes values measured by sensors and thereby determines the heating power accordingly. As sensors, temperature sensors in the area of the die cast nozzle, but also other sensors such as pressure sensors in the melting channel are planned. Temperature sensors are particularly preferred for this in the area of the melting channels inside and/or on its outer wall as well as alternatively or additionally pressure sensors used in the interior of the melting channel 4 or the sprue area 10 as shown in FIG. 1.

Particular advantages of the method according to the invention lie in the accessibility of high cycle times and minor wear of the die cast nozzle. The die casting hot channel system without sprue that comprises the die cast nozzle according to the invention also facilitates highly reproducible conditions, which result in a high, even cast part quality. Particularly the wall strengths of the cast parts can be minimised by this increased quality with corresponding saving of materials and weight.

LIST OF REFERENCE NUMERALS

1, 1' Die cast nozzle
2, 2' Heating cartridge
3 Channel carrier
4 Melt channel
5 Nozzle body
6 Heating zone
7 Supporting ring
8,8',8" Nozzle tip
9 Insulator
10 Sprue area
11, 11' Electric connection
12,12' Seat
13 Coating
14 Cross-section extension
15 Insulator ceramic
16 Conductor ceramic
17 Heating area
18 Nozzle tip section
19 Shaft
20 Channel coating
21 Melt distributor
22 Casting mold
23 Injection point
24 Injection mold star
25 Injection mold ring
26 Injection mold point
27 Injection mold flat
28 Injection mold cross
29 Item
30 Twisted pipe
31 Internal insert
32 Heating ceramic nozzle
33, 33' Nozzle shaft
34 Lateral gating
35 Head plate
36 Lateral sprue
37 Nozzle seal
38 Pressure piece, supporting element
39 Expansion bolt
40 Pressure screw
41 Thermal sensor
42 Tear-off edge
43 Front surface

The invention claimed is:

1. A die cast nozzle for use in a die casting hot chamber system for molten metal with at least one melting channel (4) in a channel carrier (3) that can be connected to a melt distributor (21), wherein the melting channel (4) passes over into a heating zone (6) and a nozzle tip (8), to which a sprue area (10) is attached, in which a plug of solidified melting can be formed that interrupts the melting flow, characterised in that the heating zone (6) comprises a heating element with electric heating, that comprises in at least one section materials with low density and high thermal conductivity, providing a high power density and low thermal inertia, such that a temperature change gradient of 20 to 250 K/s can be achieved on the surface of the heating element, wherein the die cast nozzle comprises a nozzle body (5) that encases the channel carrier (3) and the nozzle body (5) or the channel carrier (3) are comprised of titanium.

2. The die cast nozzle according to claim 1, characterised in that the nozzle tip (8) is comprised of ceramic.

3. The die cast nozzle according to claim 1, characterised in that the melting channel (4) comprises a channel coating (20).

4. The die cast nozzle according to claim 1, characterised in that at least one thermal sensor (41) is included for determining the melting temperature in the heating zone (6) and/or the sprue area (10).

5. The die cast nozzle according to claim 1, characterised in that at least one cross-section change (14) is included that limits the heat flow up to the sprue area (10).

6. The heating element for a die cast nozzle according to claim 1, characterised in that at least partially a layer structure comprised of an insulator ceramic (15) and at least one heating conductor are included, wherein the insulator ceramic (15) forms at least on one exterior of the heating element and around at least one heating conductor an electrically insulating barrier and that the heating conductor can be contacted electrically via contacts (11, 11').

7. The heating element according to claim 6, characterised in that the heating conductor is comprised of a conductor ceramic (16) or a metal conductor.

8. The heating element according to claim 6, characterised in that the heating element comprises at least one surface coating (13) or an internal insert (31).

9. The heating element according to claim 6, characterised in that at least one of the heating elements comprises an individually controllable heating conductor.

10. A heating cartridge with electric heating for a die cast nozzle according to claim 1, characterised in that the heating cartridge (2) comprises a shaft (19) that is extended to a head (44) that leads through the melt distributor, so that the contacts (11, 11') are outside of the melt distributors.

11. The heating cartridge according to claim 10, characterised in that a compensating device for balancing different thermal expansions of the channel carrier (3) and the heating cartridge (2) inserted into the channel carrier (3) is included, wherein the channel carrier (3) comprises a seat (12') for the heating cartridge (2), against which the heating cartridge (2) is pressed, wherein an expansion bolt (39), comprising a pressure screw (40) that is in connection with the channel carrier (3) in a force application zone is included, which is in connection to the heating cartridge (2) in a contact zone, so that the heating cartridge (2) is pressed against the seat (12') by the expansion bolt (39) when the channel carrier (3), heating cartridge (2) and expansion bolt (39) are heated.

12. Method for operating a die cast nozzle according to claim 1, characterised in that the steps operation of one or several heating elements with electric heating with low thermal inertia and a power density in at least one section that is sufficiently high, so that a temperature change gradient of 20 to 250 K/s can be achieved on the surface of the heating elements, wherein operation ensues with increased power, injection of the melting into a mold immediately afterwards or at the same time, reduction of power of the heating element or the heating elements or their complete deactivation, stopping the melting flow, operation of the heating element or the heating elements with such power that the melting in the heating zone (6) remains liquid, but the heat is not sufficient to maintain the melting on melting temperature in the sprue area (10) as well, wherein the melting solidifies to a plug, seals the injection point (23) and subsequent flow or reflowing of the melting is prevented.

13. Method according to claim 12, characterised in that the portion of heat flowing from the heating area (17) of the heating cartridge (2) into the sprue area (10) is at least determined by one cross-section change (14) and/or the melting is tempered in the sprue area (10) via the heatable nozzle tip (8') and/or the separately heatable tip area (18) of the heating cartridge (2), wherein at least one cross-section change (14) minimises the interaction between tip area (18) and heating area (17).

14. Method according to claim 13, characterised in that a thermal sensor (41) provides a temperature value of a melting temperature to a temperature control system that regulates the melting temperature in the heating zone (6) and/or in the sprue zone (10), so that the melting temperature is only insofar above the melting temperature of the melting that a safe melting flow is ensured.

15. The die cast nozzle according to claim 1, characterised in that the temperature change gradient 150 K/s can be achieved on the surface of the heating element.

16. The die cast nozzle according to claim 1, characterised in that the heating zone (6) comprises a heating cartridge (2).

17. The die cast nozzle according to claim 1, characterised in that the heating zone (6) comprises a heatable nozzle shaft (33').

18. The die cast nozzle according to claim 1, characterised in that the nozzle tip (8) is a heatable nozzle tip (8').

* * * * *